US008152645B2

(12) United States Patent
Walker

(10) Patent No.: US 8,152,645 B2
(45) Date of Patent: Apr. 10, 2012

(54) REMOTE GAMING ENVIRONMENT

(75) Inventor: Jay S. Walker, Ridgefield, CT (US)

(73) Assignee: IGT, Reno, NV (US)

( * ) Notice: Subject to any disclaimer, the term of this patent is extended or adjusted under 35 U.S.C. 154(b) by 391 days.

(21) Appl. No.: 12/468,901

(22) Filed: May 20, 2009

(65) Prior Publication Data

US 2009/0291762 A1 Nov. 26, 2009

Related U.S. Application Data

(60) Provisional application No. 61/054,635, filed on May 20, 2008.

(51) Int. Cl.
*A63F 9/24* (2006.01)

(52) U.S. Cl. ..... 463/43

(58) Field of Classification Search ..... 463/25, 463/29

See application file for complete search history.

(56) References Cited

U.S. PATENT DOCUMENTS 4,191,376 A 3/1980 Goldman et al.
4,299,637 A 11/1981 Oberdeck et al.
4,677,553 A 6/1987 Roberts et al.
4,814,589 A 3/1989 Storch et al.
4,982,337 A 1/1991 Burr et al.
5,166,502 A 11/1992 Rendleman et al.
5,178,389 A 1/1993 Bentley et al.
5,216,595 A 6/1993 Protheroe
5,277,424 A 1/1994 Wilms
5,283,422 A 2/1994 Storch et al.
5,290,033 A 3/1994 Bittner et al.
5,344,144 A 9/1994 Canon
5,367,148 A 11/1994 Storch et al.
5,377,975 A 1/1995 Clapper, Jr.
5,551,692 A 9/1996 Pettit et al.
5,569,082 A 10/1996 Kaye
5,651,548 A 7/1997 French et al.
5,676,376 A 10/1997 Valley
5,709,603 A 1/1998 Kaye
5,735,742 A 4/1998 French
5,791,990 A 8/1998 Schroeder et al.
5,800,268 A 9/1998 Molnick
5,830,067 A 11/1998 Graves et al.
5,941,769 A 8/1999 Order
5,988,688 A 11/1999 Such
6,017,032 A 1/2000 Grippo et al.
6,021,949 A 2/2000 Boiron
6,142,872 A 11/2000 Walker et al.
6,173,267 B1 1/2001 Cairns
6,296,190 B1 10/2001 Rendleman
6,309,298 B1 10/2001 Gerow
6,508,709 B1 1/2003 Karmarkar
6,567,159 B1 5/2003 Corech
6,645,075 B1 11/2003 Gatto et al.
6,695,696 B1 2/2004 Kaminkow
6,709,331 B2 3/2004 Berman
6,780,564 B2 8/2004 Lawandy et al.
6,863,608 B1 3/2005 LeMay et al.
6,884,170 B2 4/2005 Rowe
6,918,831 B2 7/2005 Nguyen et al.
6,929,546 B2 8/2005 Moore et al.

(Continued)

*Primary Examiner* — Fernando L Toledo
(74) *Attorney, Agent, or Firm* — K&L Gates LLP

(57) ABSTRACT

A gambler's gaming experience is extended outside the traditional gaming environment by providing a remote gaming environment that duplicates the sights, sounds, smells, and experience of a traditional casino floor. The remote gaming environment may be networked into a customer service center to help resolve issues and prevent fraud.

27 Claims, 10 Drawing Sheets

U.S. PATENT DOCUMENTS

| | | | | |
|---|---|---|---|---|
| 6,935,949 | B1 | 8/2005 | Murphy | |
| 6,964,609 | B2 | 11/2005 | Haag et al. | |
| 7,029,009 | B2 | 4/2006 | Grauzer et al. | |
| 7,233,922 | B2 | 6/2007 | Asher et al. | |
| 2004/0016620 | A1 | 1/2004 | Davis | |
| 2004/0022520 | A1 | 2/2004 | Kinzer et al. | |
| 2004/0053675 | A1 | 3/2004 | Nguyen et al. | |
| 2004/0137987 | A1 | 7/2004 | Nguyen et al. | |
| 2004/0147311 | A1* | 7/2004 | Fujimoto | 463/25 |
| 2004/0152504 | A1 | 8/2004 | Herrmann et al. | |
| 2004/0152509 | A1 | 8/2004 | Hornik | |
| 2004/0207156 | A1 | 10/2004 | Soltys et al. | |
| 2004/0219982 | A1 | 11/2004 | Koo et al. | |
| 2004/0229677 | A1 | 11/2004 | Gray et al. | |
| 2004/0235550 | A1 | 11/2004 | McNally et al. | |
| 2005/0026681 | A1 | 2/2005 | Grauzer et al. | |
| 2005/0043089 | A1 | 2/2005 | Nguyen et al. | |
| 2005/0045503 | A1 | 3/2005 | Wong et al. | |
| 2005/0051955 | A1 | 3/2005 | Schubert et al. | |
| 2005/0059493 | A1 | 3/2005 | Tyson et al. | |
| 2005/0062226 | A1 | 3/2005 | Schubert et al. | |
| 2005/0113166 | A1 | 5/2005 | Grauzer et al. | |
| 2005/0114272 | A1 | 5/2005 | Hermann et al. | |
| 2005/0119042 | A1 | 6/2005 | Chamberlain et al. | |
| 2005/0124407 | A1 | 6/2005 | Rowe | |
| 2005/0130728 | A1 | 6/2005 | Nguyen et al. | |
| 2005/0170881 | A1 | 8/2005 | Muskin | |
| 2005/0192087 | A1 | 9/2005 | Friedman et al. | |
| 2005/0193209 | A1 | 9/2005 | Saunders et al. | |
| 2005/0219200 | A1 | 10/2005 | Weng | |
| 2005/0239530 | A1 | 10/2005 | Walker et al. | |
| 2005/0250567 | A1 | 11/2005 | Kane et al. | |
| 2005/0250569 | A1 | 11/2005 | Kane et al. | |
| 2005/0250571 | A1 | 11/2005 | Kane et al. | |
| 2005/0250575 | A1 | 11/2005 | Kane et al. | |
| 2005/0250576 | A1 | 11/2005 | Kane et al. | |
| 2005/0255905 | A1 | 11/2005 | Duke et al. | |
| 2005/0277459 | A1 | 12/2005 | Haag et al. | |
| 2006/0068895 | A1 | 3/2006 | Nguyen et al. | |
| 2006/0077036 | A1 | 4/2006 | Roemerman et al. | |
| 2006/0148562 | A1 | 7/2006 | Walker et al. | |
| 2007/0052167 | A1 | 3/2007 | Galatan | |
| 2007/0060321 | A1 | 3/2007 | Vasquez et al. | |
| 2007/0293293 | A1 | 12/2007 | Baerlocher et al. | |
| 2008/0009334 | A1 | 1/2008 | Walker et al. | |
| 2008/0026826 | A1* | 1/2008 | Groswirt | 463/25 |
| 2008/0085769 | A1 | 4/2008 | Lutnick et al. | |
| 2009/0111573 | A1 | 4/2009 | Iddings | |

* cited by examiner

REMOTE GAMING DATABASE

| REMOTE GAMING SESSION ID | REMOTE PLAYER ID | GAME TYPE | LIVE GAMING LOCATION ID | DURATION OF SESSION | TOTAL AMOUNT WAGERED | TOTAL SESSION WINNINGS |
|---|---|---|---|---|---|---|
| RGID-31234-1 | PLYR-38795-3 | BACCARAT | C1-L45-D234 | 1HR, 37 MINS. | $2,050 | $3,250 |
| RGID-12390-2 | PLYR-42395-4 | BLACKJACK | C34-L335-D345 | 2.5 FLAT RATE SESSIONS OF 75 HANDS | $500 | -$500 |
| RGID-98945-4 | PLYR-24586-9 | BACCARAT | C1-L44-D234 | 1HR, 37 MINS. | $52,500 | $30,250 |

FIG. 9

REMOTE GAMING CUSTOMER SERVICE ISSUE DATABASE

| REMOTE CUSTOMER SERVICE ISSUE ID | REMOTE PLAYER ID | ISSUE TYPE | ISSUE PRIORITY | ISSUE STATUS | TIME TO RESOLVE | ESTIMATED TIME OF RESOLUTION |
|---|---|---|---|---|---|---|
| ISS-42340-3 | PLYR-23213-1 | CARD PLACEMENT | HIGH | RESOLVED | 1 MINS | N/A |
| ISS-93432-5 | PLYR-23424-2 | ILLEGAL BET MODIFICATION | HIGH | PENDING WITH TEMPORARY SUSPENSION | — | 4 MINUTES |
| ISS-02993-2 | PLYR-34234-3 | CONNECTIVITY | MEDIUM | PENDING | 6 MINS | 10 MINUTES |
| ISS-02949-2 | PLYR-34342-4 | PERIPHERAL DEVICE MALFUNCTION | MEDIUM | RESOLVED | 45 MINS 5 SECS | N/A |

FIG. 10

REMOTE GAMING ENVIRONMENT

CROSS-REFERENCE TO RELATED APPLICATIONS

This application claims the benefit of and priority to U.S. Provisional Patent Application No. 61/054,635 filed May 20, 2008.

The present application is also related to U.S. Provisional Patent Application No. 60/992,954, filed Dec. 6, 2007 and entitled METHOD AND APPARATUS FOR DISPENSING PLAYING CARDS TO A REMOTE GAME PARTICIPANT.

The entirety of each of these applications is incorporated by reference herein for all purposes.

FIELD OF THE INVENTION

The present invention relates to creating a gaming environment that duplicates the experience of a casino for a remotely positioned player and providing assistance to the player to resolve any disputes in the remote game play environment.

BRIEF DESCRIPTION OF THE DRAWINGS

FIG. 9 illustrates an exemplary set of entries for a remote gaming database.

FIG. 10 illustrates an exemplary set of entries for a remote gaming customer service issue database.

DETAILED DESCRIPTION OF THE INVENTION

Figure 1:
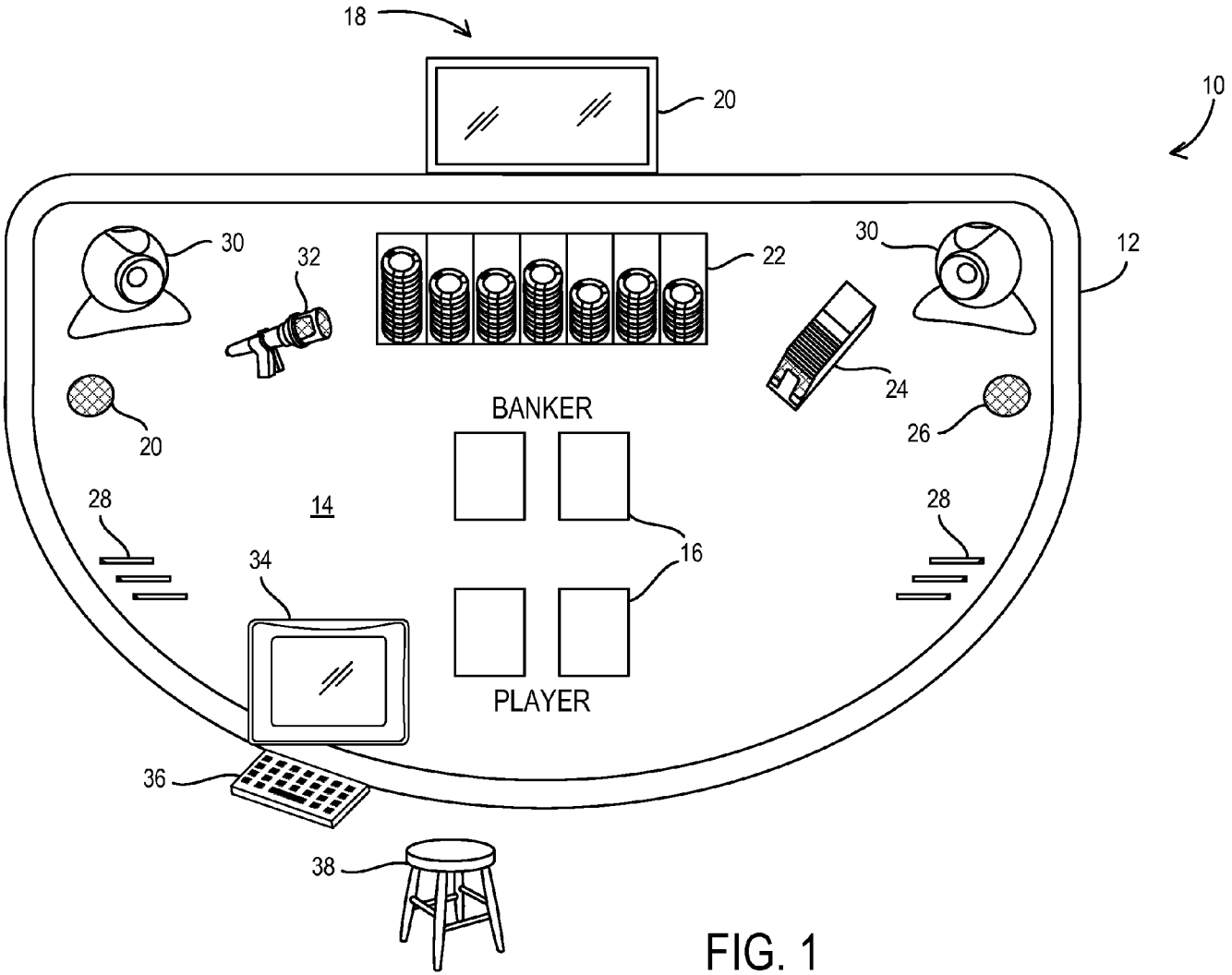
FIG. 1 illustrates an exemplary remote gaming environment.

Consumer electronic aficionados have become enamored with game devices that help duplicate an environment in which the game takes place. For example, force feedback joysticks are used to simulate the pressure a pilot might feel on his flight stick; rumble chairs are used to simulate driving forces, and the like. One field that has not copied this immersive experiential gaming is gambling. While to the casual observer it might appear that there are few environmental vectors that need to be duplicated, it is undeniable that casino floors have a certain ambiance that is missing for those players that are sitting at home, using their personal computers to play poker at an online poker website. The ringing of the slot machines, the click of the chips as they are moved about the table, the feel of the cards, the solicitous inquiries of the cocktail waitress, the plaintiff wail of the keno runners, the pleasant vapors of a nice cigar or pipe, and similar environmental effects are not readily provided to the remote gamer.

The present disclosure helps fill at least some of these missing environmental vectors while at the same time providing for a tracking mechanism which allows the gaming establishment to track activities of the remote player and help resolve disputes arising from remote player mishandling of game components or other errors at the remote location.

To this end, the present disclosure provides a remote gaming station or environment that includes elements to duplicate a table game occurring in the pit of a gaming establishment. The remote gaming station may include a playing surface, a shoe to print cards, chips for use in placing and paying wagers, microphones, speakers, smoke machines, cameras, and the like. A player using the remote gaming station receives information about game play that is occurring in substantially real time at a table in the casino pit along with instructions on how the remote player may duplicate, as well as, interact with the game play at the table. The cameras and other input mechanisms capture the player's activities and provide this information to a customer service representative. The customer service representative may not be involved in the game as a player or dealer (although such is not strictly required), and may not even be an employee of the gaming establishment, but rather could be an employee of an independent third party hired for the purpose. If the remote player needs assistance, the remote player may send a request to the customer service representative who then provides what assistance is requested. Alternatively, if the customer service representative detects an error in the game play of the remote player, the customer service representative may initiate contact with the remote player and provide assistance to correct the error. As still an added benefit, the customer service representative may detect whether a remote player is attempting to cheat and take steps to prevent the cheating. In an alternate embodiment, at least some of the detection steps may be automated. For example, if an RFID interrogator reports a change in chip count at a time when such is not allowed, a control system may provide an alert as to the error.

A more detailed presentation of an exemplary remote gaming environment 10 is illustrated in FIG. 1. The remote gaming environment 10 is, in a first embodiment, installed in a hotel room associated with a gaming establishment such as a casino. For example, in a high roller suite, a room could be set aside to contain the remote gaming environment. Such a placement allows information technology (IT) personnel of the gaming establishment to guarantee that all the connections are properly in place as well as provide maintenance to insure continued correct operation. Likewise, as explained in greater detail below, such placement allows a customer service representative to provide enhanced personal assistance to the remote player. However, while it is specifically contemplated that the remote gaming environment 10 be positioned in the hotel of the gaming establishment, such placement is not required. Rather, the remote gaming environment 10 could be in the home of a remote player or other location such as an internet café, a kiosk, or the like.

The remote gaming environment 10 may include a table 12 with a planar playing surface 14. Felt may be used as an appropriate surface for the planar playing surface 14. Card indicia 16 may be preprinted on the planar playing surface 14. For the sake of example, the present disclosure will use a table 12 suited for baccarat, although it should be understood that tables for other games such as blackjack, three card poker, four card poker, Caribbean Stud®, Let It Ride®, Spanish 21, and the like are contemplated. For this example, the card indicia 16 indicate where the two banker cards are to be positioned as well as where the two player cards are to be positioned on the planar surface 14.

A pseudo dealer position 18 is positioned on one side of the table 12. The pseudo dealer position 18 may include a display 20 that shows imagery from a live game that forms the basis of the remote game play, instructions to the player, an image of a customer service representative, and/or other information as desired and further explained below. The display 20 may be a display as that term is defined in the Rules of Interpretation and General Definitions set forth below. The pseudo dealer position 18 may also include a chip dispenser 22, which, in an exemplary illustrated embodiment is a chip rack similar to those used on casino tables as is well understood. Additionally, a remote card shoe 24 may be associated with the pseudo dealer position 18. The remote card shoe 24 may print or dispense cards for use by the remote player and in such a manner that the remote player is provided the same cards as those currently in play at the live game. For more information about a remote card shoe, the interested reader is directed to the previously incorporated '954 application. Other smart shoes include those described in U.S. Pat. No. 7,029,009, which is hereby incorporated by reference in its entirety or the iShoe Intelligent Shoe sold by Shuffle Master.

The chips used in the remote gaming environment 10 may be RFID tagged chips using appropriate RFID interrogators. Specifically, the chips may include a radio frequency identification (RFID) tag or memory with an electronic circuit or processor and an antenna. The chip may be similar or identical to those disclosed in U.S. Pat. Nos. 5,166,502; 5,676,376; 6,021,949; and 6,296,190, and U.S. Patent Application Publication No. 2004/0219982, all of which are all incorporated by reference in their entireties. Gaming Partners International (GPI), of 1182 Industrial Road, Las Vegas, Nev. 89102 and Shuffle Master, Inc. of 1106 Palms Airport Drive, Las Vegas Nev. 89119 both sell RFID chips suitable for use with the present disclosure, although neither product is specifically required to practice the concepts of the present disclosure. The GPI chip uses a standard microchip made by Philips Semiconductors called the Vegas S, each of which has a unique serial number. The gaming establishment (e.g., casino) or other entity may associate values with each serial number. The association may be in a look-up table or the like. Alternatively, the unique identifier may be encoded to include information therein. Likewise, the chips may be color-coded or include other indicia, such as indicia that indicate values to the player or dealer.

In use, the electronic circuit and antenna act as a transponder capable of responding to an interrogator (not shown). In essence, the interrogator sends out an electromagnetic signal that impinges upon the antenna, exciting a current within an electronic circuit. In response to the excited current, the electronic circuit causes the antenna to emit a second electromagnetic signal as a response, which is received by the interrogator. The second signal has identifying information about the chip encoded therein such that the interrogator can identify the chip on receipt of the second signal. The second signal may be generated passively or actively. That is, in a first embodiment, the energy from the interrogation signal provides sufficient power for the electronic circuit to use to send the second signal. In a second embodiment, the electronic circuit may include a battery or other power source, which is used to power the generation of the second signal. While batteries have increasingly small footprints and longer lives, it is generally more practical to have a passive transponder.

The chip dispenser 22 may be one such interrogator. An exemplary chip rack of this sort is made by GPI under the trade name CHIP BANK READER. Alternatively, the interrogators described in U.S. Pat. Nos. 4,814,589; 5,283,422; 5,367,148; 5,651,548; and 5,735,742—all of which are incorporated herein by reference in their entireties—could be used. Another RFID tag and interrogator suitable for use with at least some embodiments of the present disclosure are produced by Texas Instruments as the TAG-IT™ product line. An improved interrogator is discussed in U.S. Patent Application Publication No. 2006/0077036, which is also incorporated by reference in its entirety.

A variety of output devices may be used to create the remote gaming environment 10. As illustrated, speakers 26 provide sounds from the casino floor. These sounds may be transmitted live from a position proximate a table hosting the live game that forms the basis of the remote game play. Alternatively, the sounds may be pre-recorded or come from another location as desired. Speakers 26 may also be used to convey audible messages to the player and/or facilitate audible communication with a customer service representative as explained in greater detail below. Vents 28 are operatively connected to a scent dispenser, such as the MICRO TIMEMIST PROGRAMMABLE METERED SCENT DISPENSER™ or the like to create smoke and other smells that are found on the casino floor.

A variety of inputs allow the gaming establishment to track activity at the remote gaming environment 10. One or more cameras 30 may be positioned such that all of the playing surface (e.g., the card indicia 16) and/or the remote player may be captured. It is contemplated that the cameras may have motorized tracking that automatically follow the remote player and/or her actions, including autofocus features, light correction, and the like. An exemplary camera is the QuickCam Orbit AF from Logitech. A microphone 32 may capture oral comments, exclamations, or other utterances made by the remote player. Furthermore, the remote player may be provided a display 34 which may be a touch screen display and/or have a keyboard 36 with which the player may type commands or select options from menus or the like. The display 34 may be a display as that term is defined in the Rules of Interpretation set forth below. Still other input mechanisms may be used as desired.

More mundane elements such as a stool 38, mini bar (not shown), or the like may be positioned proximate the table 12.

Figure 2:
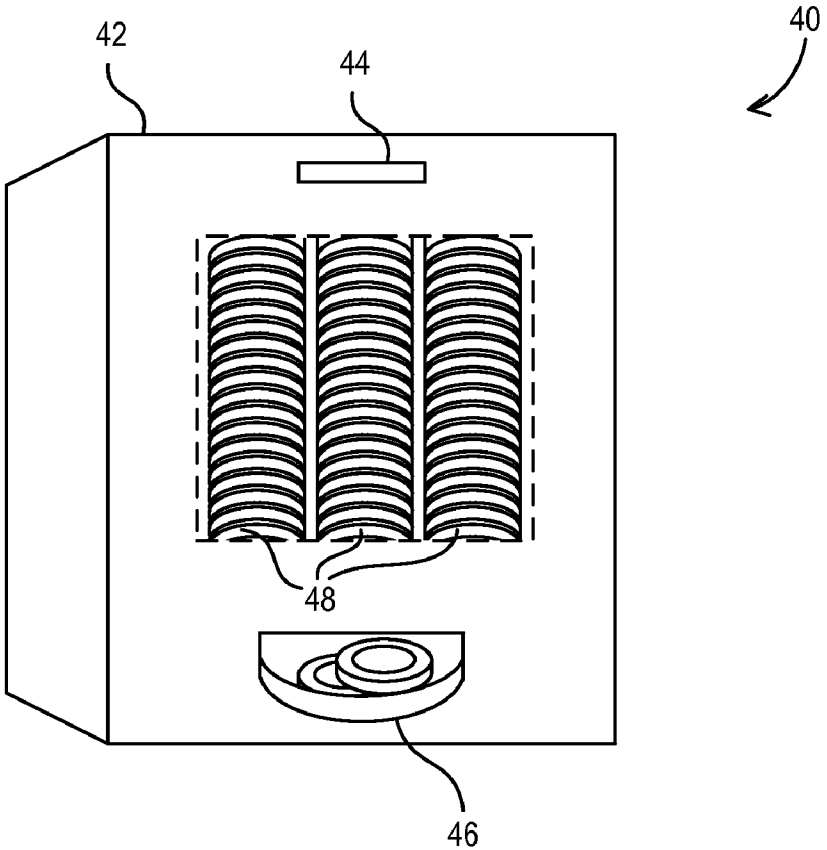
FIG. 2 illustrates an exemplary chip dispenser for use in a remote gaming environment.

While the chip dispenser 22 is illustrated as a chip rack, it should be appreciated that other chip dispensers could be used, such as, for example, the chip dispenser 40 illustrated in FIG. 2. Chip dispenser 40 is more like a coin sorter, with a housing 42 delimiting a slot 44 and a chip hopper 46. As players place wagers, the player inserts the chips into the slot 44 where conventional mechanisms sort the chips by denomination (e.g., using color detection, size detection, RFID interrogation, or the like) into separate stacks 48. When a payout is indicated, the chip dispenser 22 may release an appropriate number of chips of the appropriate denomination into the chip hopper 46 much like a vending machine releases change. The chip dispenser 22 may be locked with a tamper evident lock and replenished as desired by the gaming establishment. Such security measures may not be necessary if the chips are non-cashable chips. However, even in non-cashable chip embodiments, control over the number of chips dispensed to the player and received from the player as wagers may be facilitated by such a dispenser 40.

Figure 3:
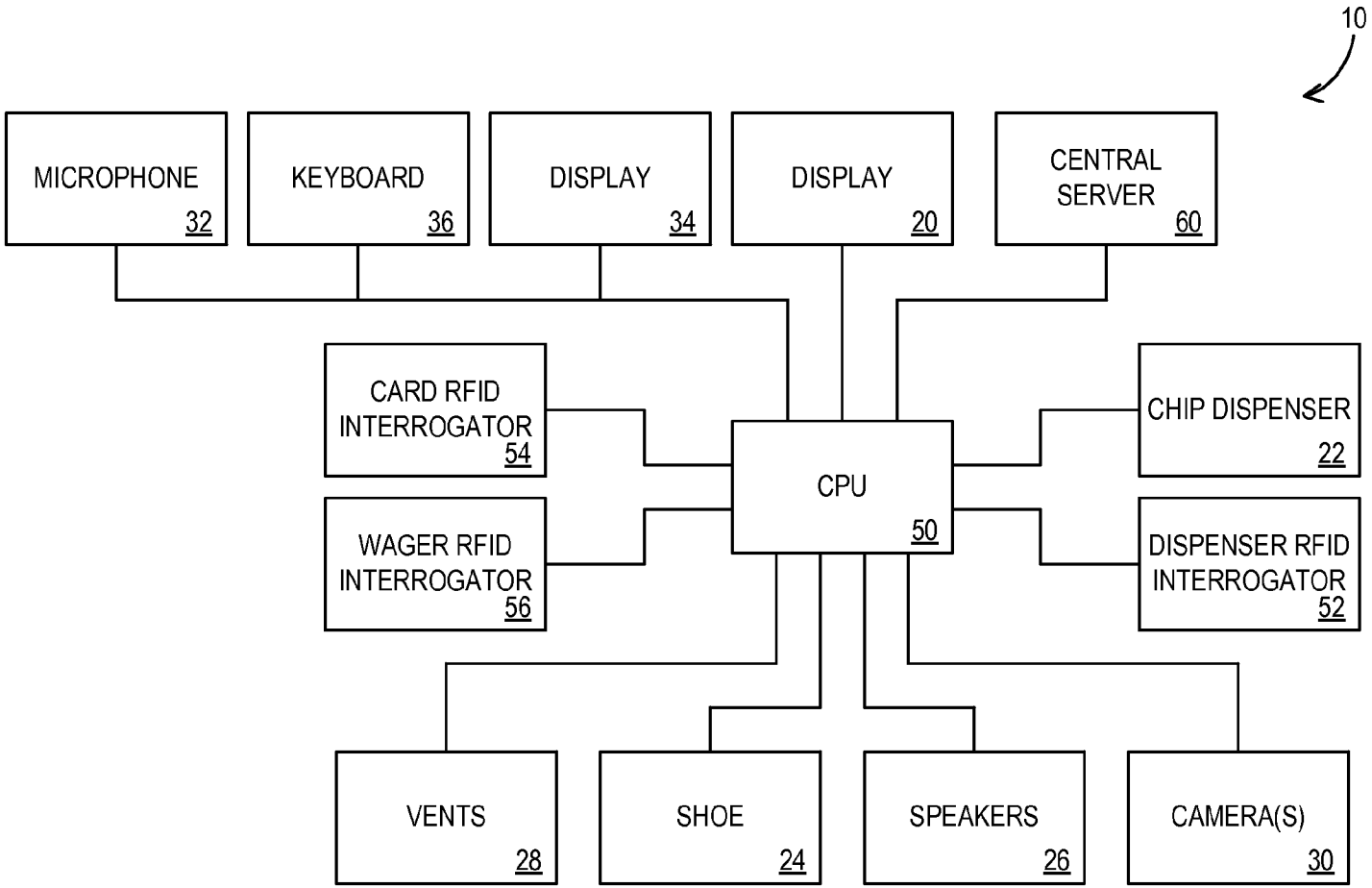
FIG. 3 illustrates an exemplary block diagram of a remote gaming environment.

A block diagram of the remote gaming environment 10 is illustrated in FIG. 3 with some additional elements explicated that are not readily apparent to the remote player. The remote gaming environment 10 includes a central processing unit (CPU) 50 that communicates with the various elements of the remote gaming environment 10. The CPU 50 may be a control system as that term is defined in the Rules of Interpretation and General Definitions set forth below. The CPU 50 is operatively connected with display 20, chip dispenser 22, shoe 24, speakers 26, vents 28, cameras 30, microphone 32, display 34, and keyboard 36, all previously described. Additionally, the CPU 50 may be operatively connected with a chip dispenser RFID interrogator 52 that interrogates chips positioned within the chip dispenser 22. Alternatively, the chip dispenser 40 may be equipped with a control system that reports insertion, inventory and dispensed chips. In either event, the CPU 50 is able to determine how many chips are within the chip dispenser.

The CPU 50 may further be operatively connected to a card RFID interrogator 54 which reads an RFID tag associated with cards dispensed by the remote card shoe 24. Note that if the remote card shoe 24 does not create cards with RFID tags, then interrogator 54 may be omitted. Additionally, there may be a wager RFID interrogator 56 positioned proximate wager indicia (not shown) on the planar playing surface 14. When the remote player places chips on the wager indicia, the wager RFID interrogator 56 detects such placement and reports the same to the CPU 50. Alternatively, if the player has inserted chips into the slot 44 of the chip dispenser 40 to indicate the player's wager, the insertion may be detected and reported to the CPU 50. The elements connected to the CPU 50 are sometimes termed peripheral devices herein in that they are peripheral to the CPU 50.

The CPU 50 is communicatively and operatively coupled to a central server 60 through any appropriate network. Note that while it is contemplated that the CPU 50 be local to the remote gaming environment 10, it is possible that the CPU 50 is remotely positioned. Alternatively, the CPU 50 may be a thin client for the central server 60. The central server may manage game play between a live gaming environment (see FIG. 5) and the remote gaming environment, provide authentication of results, manage wagers, and/or payouts, and helps identify and manage customer service issues associated with remote play as further described below.

This arrangement allows the system to detect player inputs, view how the player moves cards about the playing surface, determine player wagers, and provide information to the player about the live game. More detail on the use to which this information is put is provided below.

Figure 4:
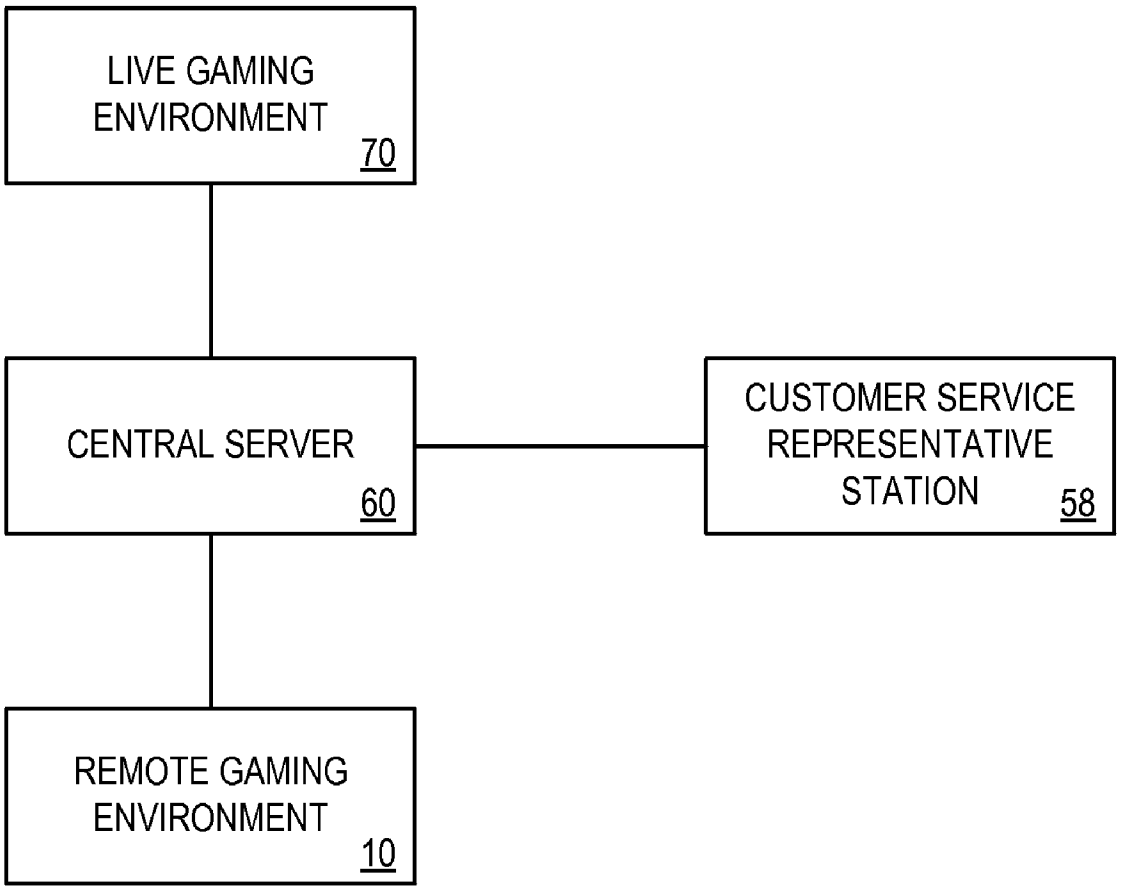
FIG. 4 illustrates an exemplary block diagram of a gaming establishment and the communication links to the remote gaming environment.

FIG. 4 illustrates an exemplary block diagram overview of the communicative links used by the remote gaming environment 10. Specifically, the remote gaming environment 10 is, as previously mentioned, communicatively coupled to the central server 60, which, in turn, is communicatively coupled to a live gaming environment 10 through an appropriate network. Additionally, the central server 60 is communicatively coupled to a customer service station 58. Customer service station 58 may be similar to a call station or the like. An exemplary station capable of being coupled to the central server may include a customer relationship management (CRM) product, such as On Demand Customer Relationship Management product provided by RightNow Technologies (corporate headquarters located in Bozeman, Mont.).

Figure 5:
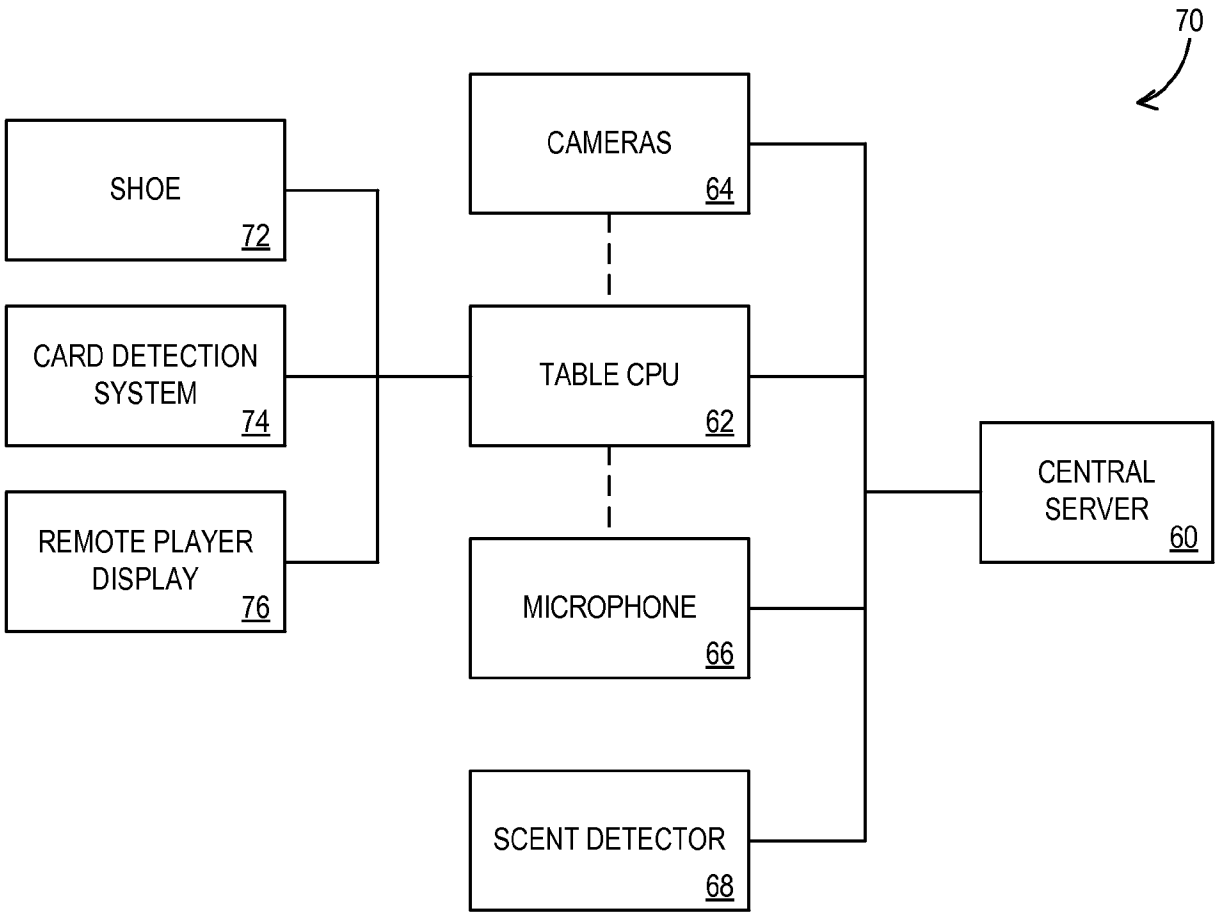
FIG. 5 illustrates an exemplary block diagram of a live gaming location within the gaming establishment.

An exemplary live gaming environment 70 is illustrated in FIG. 5. The central server 60 is communicatively and operatively coupled to a table CPU 62, security and other cameras 64, a microphone 66, and a scent detector 68. Alternatively the table CPU 62 may be connected to the cameras 64, microphone 66, and scent detector 68 and pass this information to the central server 60. The table CPU 62 may be communicatively and operatively coupled to a shoe 72 or other card detection system 74 (e.g., cameras or the like) and a remote player display 76. Note that the table CPU 62 may not be physically located within or proximate the physical table, but rather is associated with the table and used to collect information generated by the table. The shoe 72 or card detection system 74 should be operative to detect which cards are dealt to which positions, and may do so through any appropriate technology. Exemplary shoes capable of reading include an intelligent shoe such as the IS-T1™ and IS-B1™ or the MD1, MD2 sold by Shuffle Master or comparable devices. The shoe 72 may be able to determine which cards are being dealt to which player position through RFID technology, image recognition, a printed code on the card (such as a barcode), or the like. The particular technique used to recognize cards is not central to the present disclosure. Further information about intelligent shoes may be found in U.S. Pat. Nos. 5,941,769 and 7,029,009, both of which are incorporated by reference in their entireties and U.S. Patent Application Publications 2005/0026681; 2001/7862227; 2005/0051955; 2005/0113166; 2005/0219200; 2004/0207156; and 2005/0062226 all of which are incorporated by reference in their entireties. In place of an intelligent shoe, cameras may be used with pattern recognition software to detect what cards have been dealt to what player positions. One method for reading data from playing cards at table games is taught by German Patent Application No. P44 39 502.7. Other methods are taught by U.S. Patent Application Publication No. 2007/0052167 both of which are incorporated by reference in their entirety.

If the shoe 72 knows what card has been dealt, the dealer may have instructions as to the order in which cards are dealt so that the table CPU 62 knows what cards have been dealt to what positions. Alternatively, the cameras may be used to detect where each card is dealt.

The remote player display 74 shows a video feed from the cameras 30 so that the dealer can see what the remote player is doing. The remote player display 74 may be a display as the term is defined below. Still other elements may be present at the live gaming environment 70 as desired.

Figure 6:
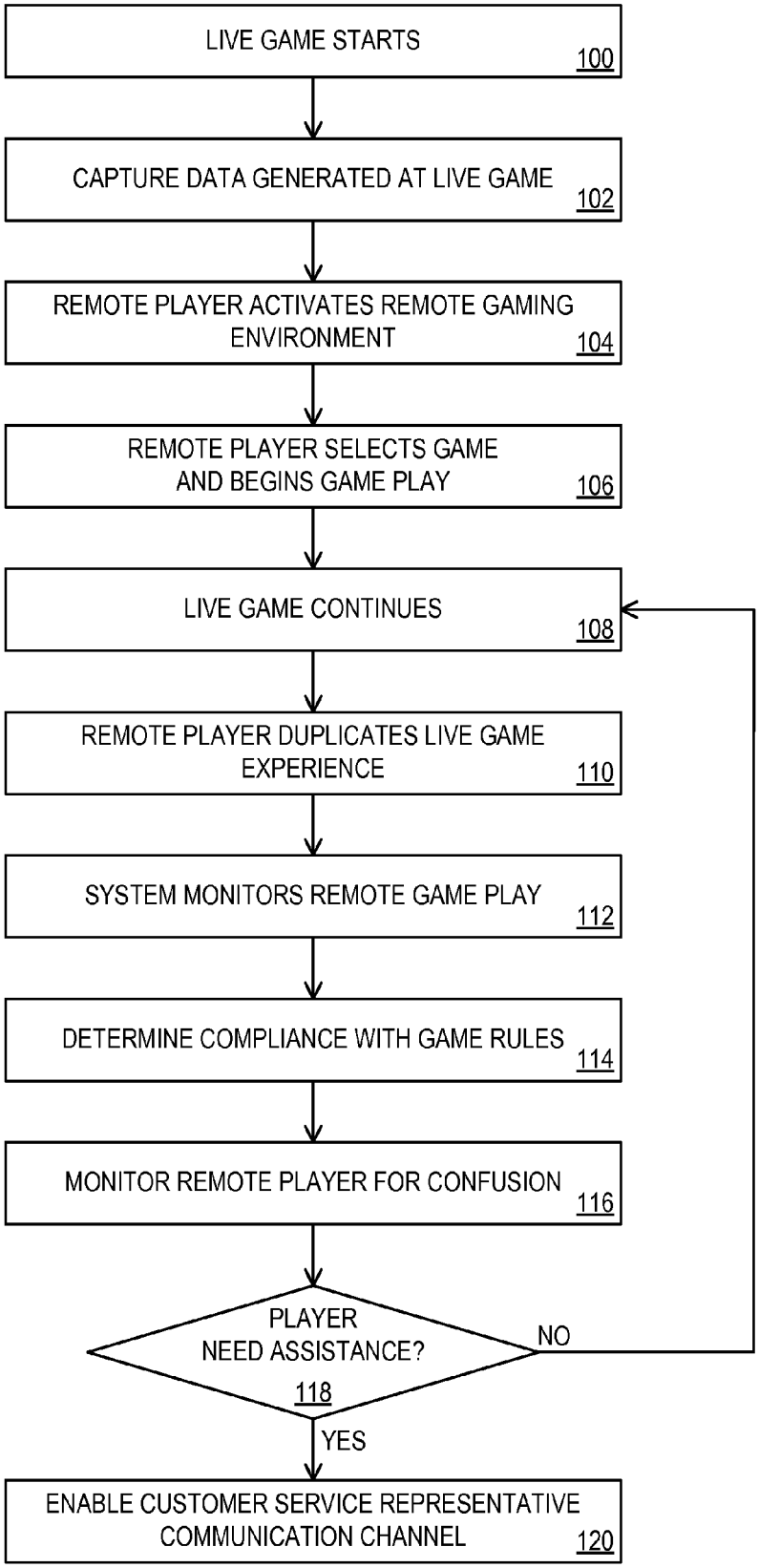
FIG. 6 illustrates an exemplary flow chart describing an embodiment of the methodology of the present disclosure.

Against this backdrop of hardware components, an exemplary methodology is provided with reference to FIG. 6. Initially a live game starts at a live gaming environment 10 (block 100). Data from the live game is captured by the cameras 64, microphone 66, scent detector 68, shoe 72 or card detection system 74, and the like (block 102). This information may be assembled by the table CPU 62 or the central server 60 as desired. A remote player activates the remote gaming environment 10 (block 104). Activation may occur prior to, essentially simultaneously with, or after the start of the live table game. However, if the live table game has not started, the remote gamer will have to find something else to occupy her until the live table game starts. Thus, the remote gaming environment may be equipped with games like solitaire or the like so that the player may pass time until the live game starts. Activation may include turning on a computer (e.g., CPU 50), turning on monitors, and the like. In an exemplary embodiment, a single switch may turn on all the electronic components, causes the CPU 50 to boot, load software and proceed. The player may be provided a menu of available options on the display 34. The menus may be provided through a WINDOWS® style interface, drop down menus, or the like. From these menus, or through other appropriate interface elements, the remote player may select a live game and begin game play (block 106). The player may register for the live table game, indicate a desire to participate in the live table game, or otherwise indicate her instructions prior to selecting a particular live game. In an exemplary embodiment, the remote player may view video footage or historical outcome information about particular live games before making a selection. For example, the remote player may select a particular table with a dealer with whom the remote player is familiar and watch a few hands being played before beginning game play. For more information about watching games, the interested reader is referred to U.S. Patent Application Publication No. 2008/0085769, which is hereby incorporated by reference in its entirety.

The live game continues (block 108). The dealer may be informed that a remote player has joined the game and video from the camera 30 may be presented on remote player display 76, although such is not required. Likewise, a customer service representative at customer service representative station 58 may be informed that the player has joined the game. Game play is captured at the live game and conveyed to the remote player. For example, cameras capture the cards being dealt and show the video of this event to the remote player. Likewise, information about cards being dealt is captured by the shoe 72 and conveyed to the remote card shoe 24 which prints out or otherwise dispenses and/or outputs the cards. The remote player may be provided not only the video of the live game, but also instructions on where to place cards as they are dealt. While not shown, lights (e.g., LEDs, or the like) could light up at the card indicia 16 when it was time to place a just dealt card from the remote card shoe 24. Instructions could also appear on the display 20 or be audibly conveyed through the speakers 26. Scents captured at the live game environment 70 by the scent detector 68 are duplicated by the scent dispenser; sounds captured by the microphone 66 are played on speakers 20. In short, the remote player duplicates or attempts to closely mimic the live game experience (block 110).

The system monitors the remote game play (block 112) through the various sensors and elements associated with the remote gaming environment 10. The control system determines compliance with the rules (block 114). Compliance may be determined by comparing data from the remote gaming environment 10 to the live gaming environment 70, and if there is a discrepancy, an alarm may be generated. This may be done automatically through the control system of the central server 60. Alternatively, the customer service representative viewing the input from the remote gaming environment 10 may detect a rules violation, or some combination of manual and automation. Likewise, the system may monitor the remote player for apparent confusion (block 116). Confusion may be evidenced by the player taking inordinate amounts of time to make decisions, misplacing of cards on the planar playing surface 14, incorrect wagers, visual expression, body language, or the like. Note that confusion may be made explicit, such as, for example, the remote player pressing a button indicating that they are seeking assistance.

Based on whether a rules violation or confusion is detected, a determination is made as to whether the remote player needs assistance (block 118). If the answer is no, the game continues. Note that a player may need assistance for other reasons besides rules violations or confusion. For example, a software, power, or hardware failure may cause the player to need assistance. If the answer is yes at block 118, then a customer service communication channel may be enabled (block 120) to assist the player in resolving the issue.

Figure 7:
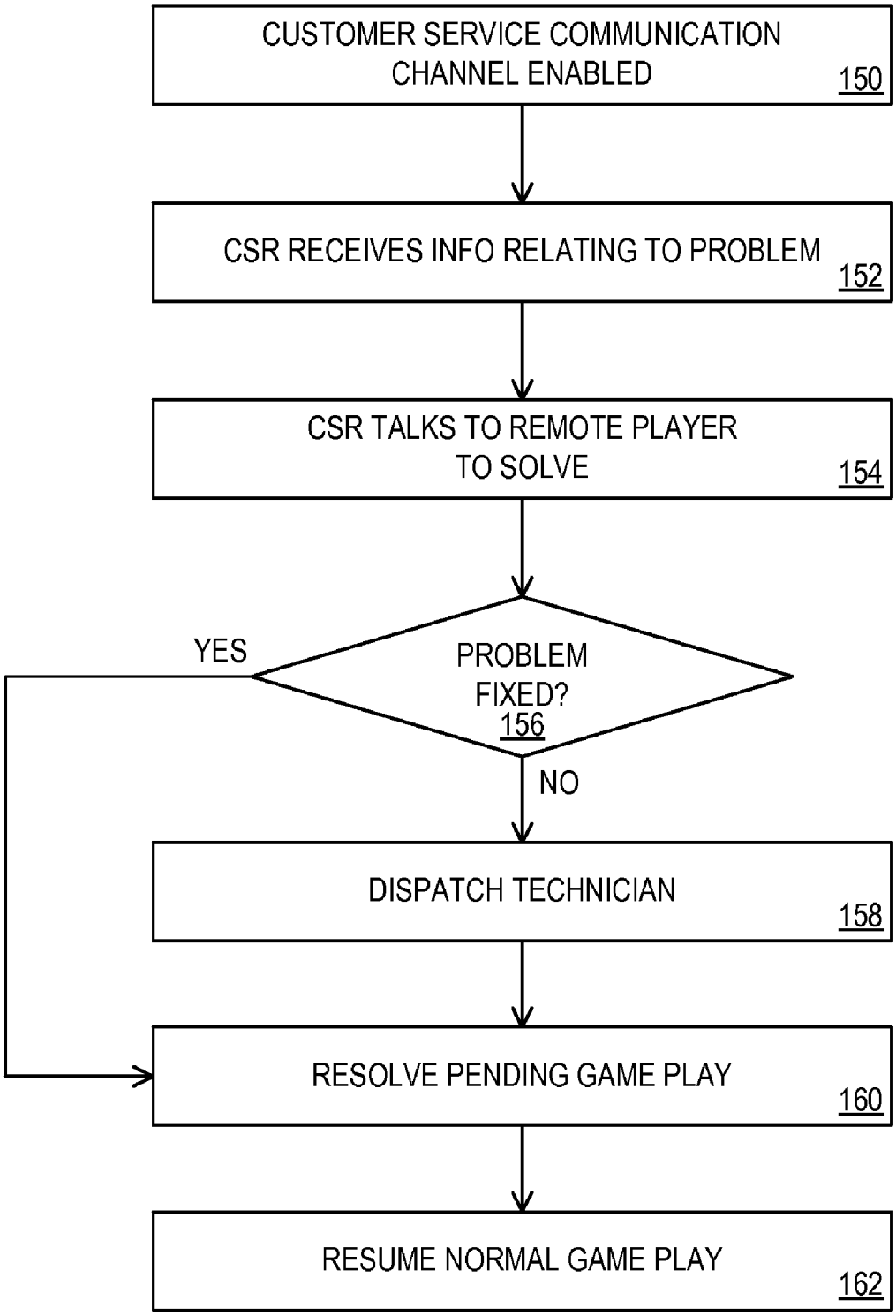
FIG. 7 illustrates an exemplary flow chart describing an embodiment of resolving remote player issues.

An exemplary flow chart of such issue resolution is presented in FIG. 7. Initially, the customer service communication channel is enabled (block 150). The communication channel may be an audio line as well as a video line (e.g., an image of the customer service representative is presented on the display 20 or 34 and speaks through the speakers 26 and listens to the player through the microphone 32). This communication channel may be effectuated through any appropriate network. The customer service representative (CSR) receives information about the problem that the player is experiencing (or creating) (block 152). The CSR may receive the video footage from the remote gaming environment 10 as well as the live gaming environment 70 as well as any other inputs which may be relevant to issue resolution. Note that some information may have to be affirmatively requested by the CSR before access is provided. This may be done to preserve bandwidth and facilitate a quicker connection.

The CSR, armed with the information about what has happened, may talk to the remote player to resolve the issue (block 154). The CSR may inform the participants, including the dealer, at the live gaming table of the problem and may offer an estimated time of resolution. The system, aided by input from the CSR if desired, determines if the problem has been fixed (block 156). If the problem is resolved with the help of the CSR, the process jumps to block 160. If, however, the CSR is not able to resolve the problem—for example, if the problem is hardware related and the CSR cannot trouble shoot the problem, the CSR may dispatch a technician to the remote player's location (block 158). If the remote gaming environment 10 is in the gaming establishment, then the technician may arrive in a reasonable amount of time. The technician may then check connections, replace hardware, or otherwise diagnose and fix the problem being experienced by the remote gamer.

Once the problem is fixed, the CSR may then help resolve any pending game play issues (block 160). For example, if the problem was that the chip dispenser 40 did not dispense an appropriate payout on a winning wager, the winning payout would be dispensed. In another example, if the communication channel to the live game failed after the wager was placed but before the hand was ultimately resolved, the end of the hand could be shown to the player and the wager resolved according to the outcome. Resolution of such issues may be according to any pre-published rule set (e.g., all such hands are declared pushes) agreed to by the remote player.

After resolution of any pending game play issues, normal game play resumes (block 162). Note that resolution of such issues may require the remote player to sit out of several hands that occur at the live game.

Figure 8:
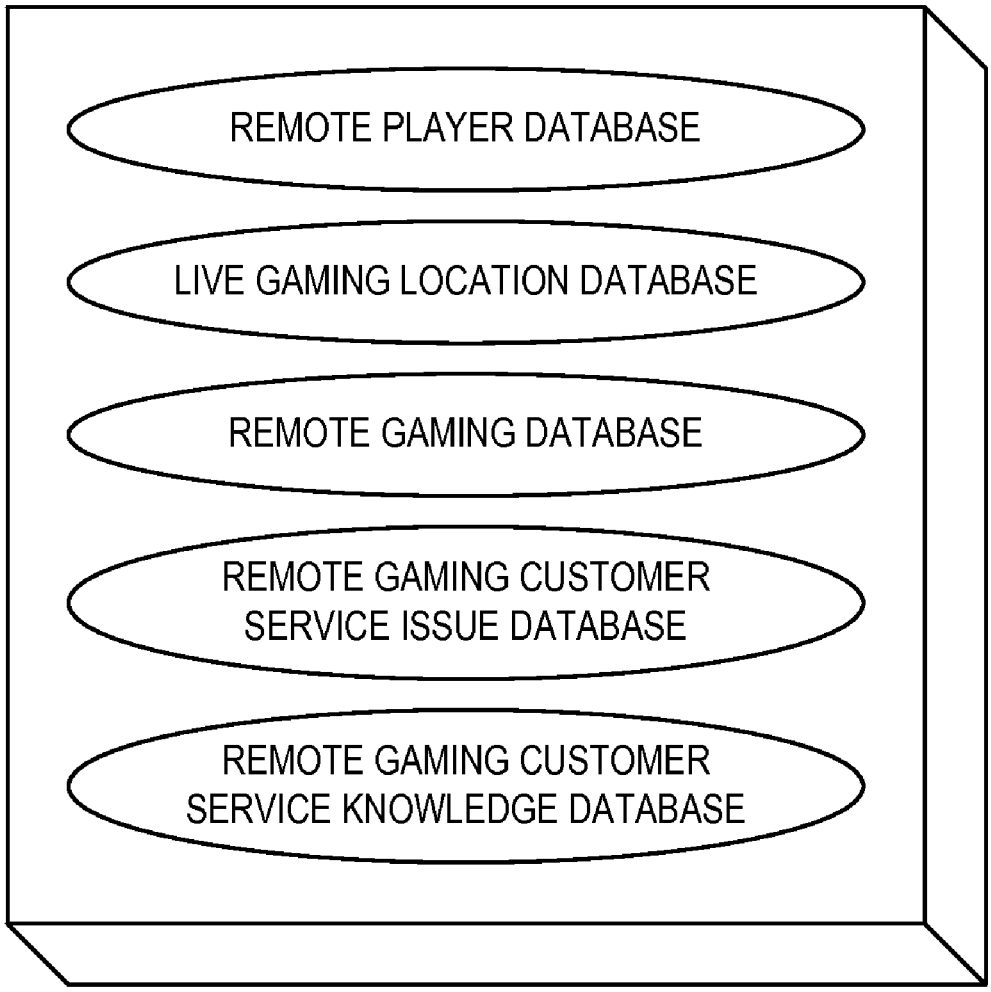
FIG. 8 illustrates a number of databases that may be used to support the present disclosure.

While there is any number of ways to facilitate the present disclosure, the central server 60 may have a number of databases stored in computer readable memory associated therewith. An exemplary set of databases is illustrated in FIG. 8 and include a remote player database which lists all the currently active and/or authorized remote players; a live gaming location database, which lists all locations that have necessary and sufficient apparatus to support remote gamers based on game play at that location; a remote gaming database, which lists all currently active remote gaming sessions; a remote gaming customer service issue database, which lists all currently pending issues associated with remote players; and a remote gaming customer service knowledge database, which may contain scripts and other trouble shooting items to assist the CSR in resolving issues as they occur.

An exemplary version of the remote gaming database is illustrated in FIG. 9. As illustrated, the database includes a remote gaming session identifier, a remote player identifier, a game identifier, an associated live gaming location identifier, and some additional information such as how long the remote player has been playing, how much she has wagered, and how much she has won (if any). Other information may be included if desired.

An exemplary version of the remote gaming customer service issue database is illustrated in FIG. 10. As illustrated, the database includes a remote customer service issue identifier, a remote player identifier, an issue type, an issue priority, an issue status, how much time it took to resolve the issue and/or an estimated time to resolution. Other information may be included if desired.

ALTERNATE EMBODIMENTS

In place of the chips or cards described above, various technologies incorporating light emitting devices may be used. In essence the light emitted by the game element is identified by a light detector, converted to a digital signature and the denomination (value, rank, suit, or the like) is determined. U.S. Pat. No. 6,567,159 describes such light devices in greater detail and is herein incorporated by reference in its entirety.

In place of other devices described above, special felt with markings like LIVESCRIBE could be used. This functionality could be used for the cards and chips as well. For more information, the interested reader is directed to www.livescribe.com.

In place of the microphone and speakers, a phone, perhaps a Voice Over Internet Protocol (VoIP) phone running an application such as SKYPE could be used.

As an additional precaution, a security measure may be provided to verify the identity of the remote player. The remote player may have to provide biometric information, use a PIN, enter a password, log in through an appropriately secure interface, or otherwise prove that he is authorized to act as the remote player. Such security provisions may act as a barrier to prevent underage players from playing; be required to access an associated line of credit, or other financial account associated with a particular player, or perform other functions as desired or as dictated by a governing regulatory agency.

Still another security measure is that the remote player must be visible by one or more cameras. If the remote player is not so visible, then game play may be discontinued, the communication channel may be enabled, or other instruction to the remote player to move into a location where she is visible to the camera may be provided. Such a requirement may allow game play at the live table to not be slowed by a remote player who has stepped away to use the restroom, take a break, or otherwise has suspended play, and may likewise help provide the biometric information needed to verify the identity of the remote player.

While various types of monitoring or tracking of remote player activity are discussed above, it should be appreciated that the various inputs allow tracking of many different elements within the remote gaming environment 10. Specifically, the chip dispenser 22, the dispensing of cards from the remote card shoe 24, the placement (or removal) of cards on the planar playing surface 14, the placement of wagers, what chips are being used to make wagers, connectivity between the remote gaming environment 10 and the central server 60 (e.g., is there lag in the network, has a connection been dropped, are packets being dropped, and the like), the collection of winnings from a successful wager, the removal of chips from a betting area, adding one or more chips to a betting area, response times by the remote player (e.g., how long does it take the remote player to make a wager, place a card, collect winnings, and the like), strategy decisions made by the player compared to a hypothetical perfect play model, may all be monitored. The various inputs allow for audible monitoring, visual monitoring, and electronic monitoring.

While it is expected that the monitoring may be continuous and that the provision of data from the live gaming area to the remote gaming environment 10 will be continuous, such is not strictly required. Likewise, the monitoring of data from the remote gaming environment 10 may not be continuous, but could be performed by polling the remote gaming environment periodically (e.g., every three seconds). Alternatively, the tracking may occur at discrete times such as particular times prior to game play (e.g., the type of game felt may be determined, the cameras may be tested for operational status, other input devices may be tested for operational status, and/or a biometric reading from the player may be taken prior to receiving a wager); during game play (e.g., the placement of cards, the placement of wagers, confirmation of any wager made, or the like); post game play (e.g., the amount of winnings awarded to the remote player from the chip dispenser 22), and/or prior to rewarding a payout from game play.

In addition to monitoring remote game play, the inputs from the various components of the remote gaming environment 10 may be stored for later review, use during audits and/or payouts, use during dispute resolution, or other purpose as desired. Such stored information may be time stamped, encrypted with a time stamp, or otherwise authenticated in such a manner that an independent third party may verify the information in the event of a dispute.

In an alternate embodiment, tracking may be broken into various lists. For example, a first list might include actions and/or events from the live gaming environment 70, a second list might include actions and/or events from the remote gaming environment 10, and a third list might include information about actions and/or events occurring between or in transit to/from environments 10, 70. For example, the first list may indicate that a card was dealt at the live table at 4:00:00, that it was placed at position one at 4:00:02 and that this information was sent to the central server 60 at 4:00:04. The third list may show that the information was received at 4:00:05 and sent to the remote gaming environment 10 at 4:00:06. The second list may show that the information was received at 4:00:08 and a card was dispensed at 4:00:18 and that the player put the dispensed card at position 2 at 4:00:25. The information on the lists may include meta information as desired.

As an alternate safeguard, a confirmation process may be provided to confirm that the wager placed was the wager intended by the player. This confirmation may be done audibly, e.g., the dealer sees the wager on the display 74 and orally inquires if the player meant to place the wager. The remote player may then confirm the wager orally. Alternatively, the process may be electronic, e.g., the CPU 50 detects the wager and inquires through the display 20 whether that was the intended wager. The player may then confirm the wager through the display 34. Variations on these processes are contemplated and within the scope of the present disclosure. Confirmations may be tracked and stored for future use.

There are various ways in which the remote player may proactively request assistance. For example, the remote player may wave at the camera 30, speak into the microphone 32, call the customer service representative through a phone (not shown), call over a VoIP phone (not shown), pressing a help button on the display 34 and/or keypad 36, utterances above a certain volume threshold captured by microphone 32, inferred requests through slow or fast response times at decision points within the game, erratic or non-optimal play, play outside normal behavior for that player, or the like may all be used to indicate that the player is requesting assistance.

While it is particularly contemplated that the remote gaming environment 10 is well suited for blackjack or baccarat, other games may be implemented. Thus, one of the functions of the cameras 30 may be to ascertain what felt is being used on the planar playing surface 14. The felt may be removable like a table cloth so that the remote player may switch games readily. Additionally, the system may detect whether the correct felt is being used relative to the associated live game.

As alluded to above, game data from various peripheral devices may be collected as part of operation according to the present disclosure. Exemplary sorts of game data include, but are not limited to: the value of a card dispensed from the shoe 24, the suit of a card dispensed from the shoe 24, any customized indicia on cards dispensed by the shoe 24, an error code on a playing card dispensed from the shoe 24, ascertaining connectivity between various components of the remote gaming environment 10, detection of a maintenance or tamper code from an element of the remote gaming environment, make and model of the remote gaming environment 10, serial number of a remote roulette wheel, or the like. In addition to hardware game data, game play game data may be collected, including, but not limited to: determining where a card is placed (i.e., was the card positioned on the planar playing surface properly?), late movement of cards, removal of cards, wagers placed, late movement of wagers, removal of wagers, movement of chips into and out of the chip dispenser 22, whether a card has been turned over or otherwise revealed at the appropriate time, the sequence of cards being dealt, the sequence of bets being received, determining timing of wager confirmations, determining timing of player requests for assistance, and the like.

As a further precaution, a remote player may be required to receive approval before undertaking an action such as placing a wager. If the player proceeds without approval, the bet may be considered invalid. The approval may be audible through the speakers 20, visually through the display 20 or 34, or otherwise provided as desired.

While the present disclosure contemplates perfect operation, redundant features (hardware and/or software) may be provided so that failure of a single component does not disrupt game play for the remote player. However, the system may still be designed to detect failures in every component and communication link, including but not limited to: connectivity between the casino, the remote gaming environment 10, and/or the customer service station 58, connectivity to one or more gaming apparatus at the remote gaming environment 10, the operational status of the gaming establishment's internal network, whether the cameras 30 are in focus, or whether the shoe 24 is printing extraneous elements on the cards.

In an effort to relieve a call center of incoming calls/issues (i.e., low priority items, issues that may be quickly resolved through use of technology) and related customer service management tasks, an operator computer may receive game data to processes the information. The operator processor may act as a "filter" of data such that the call center is only notified when a problem has been detected. The operator processor may aid the call center with automatic notifications of issues, so that the call center can focus on problems that cannot be detected or resolved automatically (e.g., the operator processor may automatically determine that the remote player has incorrectly dealt received cards to the Player and Banker positions by comparing the card positions at the remote location to corresponding positions at the live location. The issue may then be presented to a customer service representative to handle issue resolution). The transmitted game data may be received by the gaming server and may be accessed by the casino or third party affiliate (i.e., a designated call center responsible for dealing with customer services issues related to remote gaming)

Game data as described above may be sent to the customer service representative on a continuous or semi-continuous basis. There are many ways to output the game data to a customer service representative, including, but not limited to: graphically (e.g., computer-generated image according to transmitted position, a highlight on video according to transmitted position, an image of the remote player's gaming area is displayed and potential problem areas are highlighted, a streaming video is broadcast and as the issue occurs a graphic "arrow" indicates the error, a streaming video zooms in on a remote player to emphasize his need for help, an image of the current remote player is displayed side-by-side to the remote player's profile picture, an amount of betting chips in a given area are represented with graphs and/or tables, an image of the remote printing shoe is displayed and graphic representations of the last four printed playing cards are displayed, an icon is displayed alerting a representative of a transmission (i.e., text message, email, request for help), a graphical clock showing how long the remote player has been waiting, a graphical timeline of actions and events are displayed), electronically, or some combination of the two. Electronically output data may include textual information (e.g., an email or instant message is transmitted and/or outputted with game data, data is transmitted/outputted to an electronic bulletin board for a call center, a physical description of the current remote player is shown side-by-side to the remote player's profile description, a remote player's profile details may be shown (including player name, player address, player IP address, player status, strategy characteristics, gaming history, current game situation, etc.), indication of how long the remote player has been waiting, a compilation of actions and events are displayed), or audio information (e.g., a remote player may speak directly to a customer service representative regarding game data using a landline phone, a "heated" discussion related to remote play is sent via Skype, an audio-recording describing a compilation of actions and events, a remote player may record an audio message, an incoming audio transmission may generate a different ring pattern based on game data (i.e., a remote player actuates a "Help" button and ring pattern #1 is activated, connectivity to the remote gaming location is lost and ring pattern #5 is activated)) or some combination thereof. Textually transmitted game data may include, but not limited to: an indication of a position, an indication of an orientation, an indication of a request (i.e., from a remote player, remote card shoe, gaming server, etc), an indication of an amount of betting chips, an indication of a dispensed playing card, an indication of an action (e.g., a description of a remote player waving his hands, a description of the last four printed cards from the remote card shoe), an indication of a problem area (e.g., an unauthorized modification of a wager, incorrect payout amount may be highlighted (e.g., bold font, larger font size, flashing characters), connectivity issue, malfunctioning equipment, improper game set up), and the like. Transmitted and/or outputted audio information related to game data may include, but is not limited to: an indication of a position, an indication of an orientation, an indication of a request (i.e., from a remote player, remote card shoe, gaming server, etc), an indication of an amount of betting chips, an indication of a dispensed playing card, an indication of an action (e.g., a description of a remote player waving his hands, a description of the last four printed cards from the remote card shoe, a replay of a conversation), an indication of a problem area (e.g., an unauthorized modification of a wager, incorrect payout amount may be emphasized (e.g., higher volume, deeper tone), connectivity issue, malfunctioning equipment, improper game set up), physical description of the current remote player, player profile details (including player name, player address, player IP address, player status, strategy characteristics, gaming history, current game situation, etc), an indication of how long the remote player has been waiting, and the like. Alternatively, the data may initially be screened by an automated system for problems, and the data associated with a detected problem passed onto the customer service representative. Likewise, proactive requests for help from the player may be sent through an automated response system, and only problems that cannot be resolved through the automated system may be elevated up to a human customer service representative. Alternatively, the player may utilize a self-help knowledge base system provided by the casino and/or the customer service station. Such a knowledge base system may be found in a CRM tool, such as the RightNow technologies products mentioned earlier. Any activity performed in a self-help system (e.g., keyword searches, articles and/or FAQ's access, postings, feedback) may be transmitted to a customer service representative. Given the generally prevailing attitudes regarding such automated response and/or knowledge base systems, the threshold required to reach a human representative may be low.

An issue to be resolved related to the game date may be identified in myriad ways. Likewise, the issue to be resolved could originate at a number of different points within the system and process. For example, identifying may include identifying connectivity issues through verifying that all monitoring devices are working correctly. The connectivity may be verified through periodic polling of the devices. Likewise, the connectivity of all the remote gaming devices may be checked. If the connectivity of a device fails, an alarm may be generated, an alert sent to the customer service representative, or the like. Similarly, if the connection experiences lag or is otherwise slow, a similar or differentiated alert or alarm may be provided.

There are likewise myriad ways to identify a player request for assistance, including, but not limited to: is the player making a physical gesture for assistance (e.g., waving towards a video camera), does the player appear to be confused, is there an incoming call from the player on a telephone line, cellular line, or VoIP line, is the player asking a question, is the player experiencing slow response times to a live gaming event, has the player pressed a help button, or the like.

There are various ways in which the remote gaming information may be compared to the live gaming event, including, but not limited to: reviewing the remote gaming environment 10 to see if the gaming area is set up properly (e.g., is the player using a baccarat table felt when the live game is baccarat?) such as by using one of the cameras 30 with edge detection capabilities to identify whether an incorrect table felt is being used; determining if the wager amounts are the same at the remote gaming environment 10 as they are at the live gaming location, determining whether the wagering amounts have improperly changed since the data was last received, are cards dealt at the remote gaming environment 10 the same as the cards dealt at the live gaming location; have the cards been dealt in the same order; are the actions of the remote player consistent with the live gaming event; is the placement of the RFID enabled playing cards consistent with that of the live game; is the remote player's chip count within their chip tray consistent with that of the live game; is the remote player's chip count within their chip tray consistent with the casino's account; is the position the player is orally stating she is placing a specific card the same as the position in the live game; is an awarded amount for a hand the same as the amount awarded to the player in the live gaming event; or the like. Note that a customer service representative may use two display screens to compare elements from the live game to the remote gaming environment 10. Alternatively a single screen may be used where the elements are shown next to one another.

With the various inputs, it is possible to determine, either automatically, or with the subjective review of the customer service representative, where, when, and why the issue occurred.

There are likewise many potential ways an issue may arise with a peripheral device, including, but not limited to: the remote dispensing shoe is not printing cards correctly, the remote dispensing shoe has jammed and cards are not being dispensed, a peripheral device is broadcasting an error beacon (e.g., a flashing light, a beeping tone), or the like. For example, camera 30 may lose its connection and the blue broadcasting light is no longer emitting or a card detector is not detecting cards and offers a series of beeps, or the system may detect lag in the form of the equipment performing slower than normal. Once an issue has been detected, it may further be described with reference to identifying hardware information such as the make and/or model of the offending device. Such details may be stored in a remote player account, which may be accessed as part of the process of securing the details before provision of the same to the customer service representative.

There are likewise many potential ways an issue may arise with a playing card, including, but not limited to: a playing card was incorrectly placed (i.e., in the wrong position), card positions are switched, a playing card is revealed too early, an incorrect card is dealt, the sequence of dealt cards is not consistent with the live game, the wrong playing card is printed, a playing card has an error code printed on it, a player card from another hand is improperly being re-used, or the like.

There are likewise many potential ways an issue may arise with a betting chip, including, but not limited to: an inconsistent bet is placed (e.g., a $25 betting chip has been placed within a betting circle, but registers through the RFID technology as a $50 wager and is flagged accordingly); there are inconsistent tray amounts (e.g., does the remote player's chip tray amount match the player's virtual account; did the remote player award himself more chips from a surrogate dealer's chip tray at the conclusion of the hand; did the player award himself extra betting chips into his chip tray); are all of the betting chips accounted for (i.e., do the sums of betting chips from each location add up to the total physical chips in the player's possession); cheating by adding or removing a betting chip after betting is closed; did the remote player meet the minimum bet requirement; or the like.

There may likewise be issues that arise at the live gaming table, including, but not limited to: the live gaming location loses connection to the central server and is unable to communicate with the remote player; a power outage, a natural disaster, a fight broke out, emergency services or security is onsite to address a local issue, a player wins a large payout and excitement from visitors prevents an immediate return to game play; there is a dealer shift change; or the like.

There may likewise be issues arising from unauthorized remote game play, including, but not limited to: face recognition software may receive images which do not match an authorized user, a customer service representative may recognize that a remote player is not the authorized person for play; an operator processor identifies an incorrect biometric from a remote player; a remote player is female when the player profile describes the player as male; or the like.

There may likewise be issues relating to interactions between individuals involved in the game, including, but not limited to: an argument taking place and may be identified by voice recognition that detects raised voices, the customer service representative may identify a player as being under the influence of a mind affecting substance (e.g., alcohol)

through his or her action; the customer service representative may identify cheating efforts between a dealer and the remote player based on conversation between the individuals, or the like.

There may be issues with the remote player, including, but not limited to: the remote player is playing rapidly in a manner perhaps indicative of a problem gambler; the remote player appears to be disoriented, which is not permitted according to terms of remote play; the remote player demonstrates unordinary game play strategy (e.g., the player does not use perfect play, the player deviates from historical patterns, the player places an unlikely bet); the player may have stepped away from the remote gaming environment 10; or the like.

As previously indicated, there are many ways to identify the issue, including, but not limited to: manually (e.g., a customer service representative continuously watches video or data streams and looks for mistakes, the customer service representative views the remote player and compares against a picture or physical description), automatically (e.g., processing performed by the central server or the remote control system, or some combination of the two. If the monitoring is performed automatically, automated prompts and responses may be provided to the player suggesting a correct course of actions for detected or potential issues. Such automation may filter out smaller issues and reserve the customer service representative for more important issues. If a mixed automatic and manual system is used, it may be implemented in different ways, including, but not limited to: as a rule is broken and detected with a sensor, the customer service may be initiated; the automatic processing watches for errors and alerts the customer service representative for assistance as errors are detected; face recognition software alerts the customer service representative when it detects unauthorized game play; or the like.

Once an issue has been identified, there are myriad ways to enable communication with the remote player. Contact may be initiated by the customer service representative (e.g., the customer service representative requests to communicate with the player), the player (e.g., the player presses a help button to initiate a phone call), the computer system, or an operator processor system (e.g., an IVR offers automated responses, suggestions, and the like to help quickly resolve minor issues).

If the customer service representative initiates the communication, the customer service representative may call the player, transmit a message to the player, the call may be made over a secure line with appropriate authentication procedures, the call may be made over a cellular link if the issue is related to connectivity, or other technique as desired.

The customer service representative may also contact and update others involved with the game play such as the dealer, supervisor, pit boss, or the like. The customer service representative may also contact other players, particularly if they are remotely positioned and not able to ascertain what is causing a delay. The customer service representative may also allow or enable communication between the remote players and the players at the live game event and/or between other remote players. If possible, the customer service representative may also provide an estimated time to resolution of the issue.

Communication between parties may be audible, such as through a phone, internet phone service, or the like; video based, such as through a two-way video conferencing software package; electronic, such as instant messages, texts, email, or the like. An alert may be provided to the player that the player should expect a communication from the customer service representative.

Once the communication is established, the customer service representative (or automated system) may inform the player of the issue and a proposed resolution. Any of the issues identified above may be raised, or, if another issue is detected, it may be raised as dictated by the situation.

Note that a single customer service representative may service more than one remote player and thus, if multiple issues arise proximate in time, a queue may be created. Priorities within the queue may be varied as desired based on the type of issue, the particular player (e.g., high rollers may be preferential treatment), in the order received, an amount of a wager, an amount of time waiting for an issue to be addressed, historical issues (e.g., an amount of previous remote gaming issues, address a player issue if it's their first recorded issue, address a player issue if the player has experienced similar issue in the past, place call in queue if player has been flagged accordingly), or the like.

Providing the proposed resolution may involve providing instructions to the remote player including how to reconnect disconnected hardware, how to troubleshoot hardware, offer access to a FAQ, or the like. Likewise, the customer service representative may offer instructions on how and where to deal a card; move a card to a correct location; warn the player about revealing cards too early; assist the player in ending a hand with virtual cards if the remote dispensing shoe is not operational; warn the player against reusing cards; or the like. The customer service representative may then view the video feed to see if the remote player is complying with the instructions offered by the customer service representative. In some circumstances, a customer service representative may refer to a script to properly assist in troubleshooting an issue. A call center may provide different scripts for various problem areas, such as, but not limited to: connectivity issues, peripheral device issues (e.g., a series of questions is presented to a remote player to resolve a peripheral device issue), inconsistent betting chip values (e.g., using a script, a CSR may direct the remote player to perform a test sequence to determine which betting chips are faulty), inconsistent remote player descriptions, player disorientation (e.g., using a script, a CSR may determine whether or not a remote player is under the influence and make a decision to continue or suspend game play), and the like.

If the issue is with the player's bet, the customer service representative may offer details to correct a misplaced or incorrect bet. To this end, the customer service representative may show the remote player video footage of the remote player misplacing or placing an incorrect bet. This footage may be presented on one of the remote gaming environment displays as desired. Concurrently, the customer service representative may orally explain how the bet was incorrect. Additionally, the customer service representative may be equipped with the ability to highlight portions of the video footage, much like a commentator at a sports game, and use a light pen (or the like) to circle the offending activity and draw a diagram showing where and/or how the bet should have been placed. Note that this technology could also be used to assist in correcting misplaced cards.

If the issue is resolved such that the gaming establishment owes the player money, a physical receipt may be provided to the player such as through postal mail, facsimile transmission, a downloaded coupon, an e-ticket like receipt, or the like. Alternatively, the player may be able to stop at a customer service desk at the gaming establishment and pick up the receipt or money.

Note that preferential treatment may be provided to some players depending on the player's status. VIP players may be allowed to get away with some types of cheating (e.g., below a certain dollar threshold), but once the threshold is exceeded, the player's account is suspended or canceled until the player admits to the cheating and compensates the gaming establishment for any losses incurred by the cheating. As yet another alternative, if the player cheats badly, such that the player loses more money than she would have otherwise, the gaming establishment may simply accept the cheating.

Before accusing a player of cheating, the customer service representative may direct the remote player to "test" her chips in an effort to hint to the player that the gaming establishment has detected that something is wrong. Likewise, there may be a confrontation rating system, wherein a system measures the amount of confrontation to use based on the severity of the infraction. Player status may figure prominently on such a system, where loyal customers are gradually confronted, but a new, low value customer has their account suspended immediately. Warnings may be provided as desired during game play to discourage cheating.

In place of accusing the player of cheating, the customer service representative may provide a tutorial or assistance with best practices. This may be provided in response to detection of what appears to be cheating, confusion (e.g., slow play), or the like as desired. Best practices or perfect play strategy may also be provided in such tutorials. Players may also be allowed to request proactively that they be provided a tutorial. Such may be particularly helpful to a player trying a new game such as Pai Gow, which is not immediately intuitive. Alternatively, a pop up window may be provided periodically asking if the player would like a tutorial, or the customer service representative may query the player as to whether she would like a tutorial. If a player consistently has the same problem, a tutorial may be offered to the player along with an explanation that shows why the tutorial is being offered. For example, a popup may say "Mr. Smith, we notice you always put the second card in the wrong spot, would you like a tutorial on how to place the cards in this game?"

The customer service representative may also use a script to trouble shoot issues. The script may be a series of questions (e.g., is this cable connected from this port to this peripheral device?), include test sequences of hardware (e.g., chips are tested individually to see if they are faulty), or the like. Scripts may also be designed to test that the player is the authorized user of an account (e.g., Ms. Smith, could you step back into view of the camera while you are placing your wagers?), or may be designed to elicit whether a player is under the influence such as by using field sobriety tests.

The customer service representative may act as a referee between two disputing entities (e.g., between a remote player and a dealer and/or another player) by reviewing content including stored actions and/or events from both parties. Based on this information, the customer service representative may determine which party is in the right and provide that information to the parties. If needed, higher level personnel such as a pit boss may be included and allowed to review the information to confirm the customer service representative's decision.

The customer service representative may settle an interrupted hand (e.g., a hand interrupted by a lost connection) based on an expected value for the hand, according to some other rule (e.g., all lost connections are pushes) or the like as desired. Such settlement may occur when the customer service representative receives an indication that the connection was lost. The customer service representative may make initial efforts to contact the player (although it is not strictly required to implement a settlement) and then process the settlement based on the state of the game at the time of the lost connection. Alternatively, the central server may initiate the settlement immediately that a lost connection is detected. Because players may have a desire to induce a lost connection on a bad hand, the system may also offer a settlement for any given hand based on the expected value. Thus, players who receive a bad hand may still settle and continue playing without artificially inducing a lost connection that triggers the settlement rules. Alternatively, a new game may be offered when a lost connection is re-established. The new game may be restarted with the same hand values as where in play at the time the connection was lost, or otherwise resolve the new game.

The customer service representative may also perform accounting measures such as reconciling the chips in the tray with those allowed to the player. If there is a discrepancy, the customer service representative may review the video footage to see where the discrepancy arose.

The customer service representative may also have the ability to modify game play during the resolution process. For example, game play may be temporarily suspended. If the remote player's play is suspended pending resolution of a live game table issue, the remote player may be offered a chance to switch to a different live table, a different game, or play a software based version of a game, such as solitaire or video poker. In another example of temporarily suspending game play, a customer service representative may temporarily pause or suspend a live gaming event while addressing a remote gaming issue. The representative, as discussed earlier, may inform the participants, including the dealer, at the live gaming table of the problem and may offer an estimated time of resolution. If an issue is unable to be resolved within a reasonable amount of time (e.g., 2 minutes), then the live gaming event may continue without the participation of the remote player. In another example of modifying game play, a customer service representative may dictate play-by-play or card-by-card instructions for resolving an outcome of a hand.

In some embodiments, a player may pay for the right to use or otherwise have available the customer service representative. This payment may be based on a service fee per call, per issue, a subscription fee, in the form of a rake taken from the winnings, per time spent on issue resolution, or the like. Alternatively, the service may be provided free of charge, or some mix, such as two free calls a week, 15 free minutes a session, or the like. If there is a fee, comp rewards may take the form of access to the service. For example, after 10,000 points are earned in the customer loyalty program the player is entitled to a t-shirt or fifteen free minutes access to the service.

As an alternate embodiment, a remote player may be asked to rate the service provided afterwards. This may be done for quality control, to evaluate particular customer service representative, or to help promote player goodwill.

As yet another alternative, a customer service representative may contact a player to schedule another remote gaming session.

Rules of Interpretation and General Definitions

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

Neither the Title (set forth at the beginning of the first page of this disclosure) nor the Abstract (set forth at the end of this disclosure) is to be taken as limiting in any way as the scope of the disclosed invention(s).

The term "product" means any machine, manufacture and/or composition of matter as contemplated by 35 U.S.C. §101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present disclosure, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

Where a limitation of a first claim would cover one of a feature as well as more than one of a feature (e.g., a limitation such as "at least one widget" covers one widget as well as more than one widget), and where in a second claim that depends on the first claim, the second claim uses a definite article "the" to refer to the limitation (e.g., "the widget"), this does not imply that the first claim covers only one of the feature, and this does not imply that the second claim covers only one of the feature (e.g., "the widget" can cover both one widget and more than one widget).

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device or article is described herein, more than one device or article (whether or not they cooperate) may alternatively be used in place of the single device or article that is described. Accordingly, the functionality that is described as being possessed by a device may alternatively be possessed by more than one device or article (whether or not they cooperate).

Similarly, where more than one device or article is described herein (whether or not they cooperate), a single device or article may alternatively be used in place of the more than one device or article that is described. For example, a plurality of computer-based devices may be substituted with a single computer-based device. Accordingly, the various functionality that is described as being possessed by more than one device or article may alternatively be possessed by a single device or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining, recognizing, and the like.

A "display" as that term is used herein is an area that conveys information to a viewer. The information may be dynamic, in which case, an LCD, LED, CRT, LDP, rear projection, front projection, or the like may be used to form the display. The aspect ratio of the display may be 4:3, 16:9, or the like. Furthermore, the resolution of the display may be any appropriate resolution such as 480i, 480p, 720p, 1080i, 1080p or the like. The format of information sent to the display may be any appropriate format such as standard definition (SDTV), enhanced definition (EDTV), high definition (HD), or the like. The information may likewise be static, in which case, painted glass may be used to form the display. Note that static information may be presented on a display capable of displaying dynamic information if desired. Some displays may be interactive and may include touch screen features or associated keypads as is well understood.

The present disclosure frequently refers to a "control system". A control system, as that term is used herein, may be a computer processor coupled with an operating system, device drivers, and appropriate programs (collectively "software") with instructions to provide the functionality described for the control system. The software is stored in an associated memory device (sometimes referred to as a computer readable medium). While it is contemplated that an appropriately programmed general purpose computer or computing device may be used, it is also contemplated that hard-wired circuitry or custom hardware (e.g., an application specific integrated circuit (ASIC)) may be used in place of, or in combination with, software instructions for implementation of the processes of various embodiments. Thus, embodiments are not limited to any specific combination of hardware and software.

A "processor" means any one or more microprocessors, CPU devices, computing devices, microcontrollers, digital signal processors, or like devices. Exemplary processors are the INTEL PENTIUM or AMD ATHLON processors.

The term "computer-readable medium" refers to any medium that participates in providing data (e.g., instructions) that may be read by a computer, a processor or a like device. Such a medium may take many forms, including but not limited to, non-volatile media, volatile media, and transmission media. Non-volatile media include, for example, optical or magnetic disks and other persistent memory. Volatile media include DRAM, which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during RF and IR data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave as described hereinafter, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined below and includes many exemplary protocols that are also applicable here.

It will be readily apparent that the various methods and algorithms described herein may be implemented by a control system and/or the instructions of the software may be designed to carry out the processes of the present invention.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models, hierarchical electronic file structures, and/or distributed databases) could be used to store and manipulate the data types described herein.

Likewise, object methods or behaviors of a database can be used to implement various processes, such as those described herein. In addition, the databases may, in a known manner, be stored locally or remotely from a device that accesses data in such a database. Furthermore, while unified databases may be contemplated, it is also possible that the databases may be distributed and/or duplicated amongst a variety of devices.

As used herein a "network" is an environment wherein one or more computing devices may communicate with one another. Such devices may communicate directly or indirectly, via a wired or wireless medium such as the Internet, LAN, WAN or Ethernet (or IEEE 802.3), Token Ring, or via any appropriate communications means or combination of communications means. Exemplary protocols include but are not limited to: Bluetooth™, TDMA, CDMA, GSM, EDGE, GPRS, WCDMA, AMPS, D-AMPS, IEEE 802.11 (WI-FI), IEEE 802.3, SAP, SAS™ by IGT, OASIS™ by Aristocrat Technologies, SDS by Bally Gaming and Systems, ATP, TCP/IP, gaming device standard (GDS) published by the Gaming Standards Association of Fremont Calif., the best of breed (BOB), system to system (S2S), or the like. Note that if video signals or large files are being sent over the network, a broadband network may be used to alleviate delays associated with the transfer of such large files, however, such is not strictly required. Each of the devices is adapted to communicate on such a communication means. Any number and type of machines may be in communication via the network. Where the network is the Internet, communications over the Internet may be through a website maintained by a computer on a remote server or over an online data network including commercial online service providers, bulletin board systems, and the like. In yet other embodiments, the devices may communicate with one another over RF, cable TV, satellite links, and the like. Where appropriate encryption or other security measures such as logins and passwords may be provided to protect proprietary or confidential information.

Communication among computers and devices may be encrypted to insure privacy and prevent fraud in any of a variety of ways well known in the art. Appropriate cryptographic protocols for bolstering system security are described in Schneier, APPLIED CRYPTOGRAPHY, PROTOCOLS, ALGORITHMS, AND SOURCE CODE IN C, John Wiley & Sons, Inc. 2d ed., 1996, which is incorporated by reference in its entirety.

The present disclosure provides, to one of ordinary skill in the art, an enabling description of several embodiments and/or inventions. Some of these embodiments and/or inventions may not be claimed in the present disclosure, but may nevertheless be claimed in one or more continuing applications that claim the benefit of priority of the present disclosure.

What is claimed is:

1. A method comprising:

monitoring game play conducted at a table located in a casino pit of a gaming establishment;

providing information about the conducted game play to a remotely positioned player;

instructing the remotely positioned player to mimic the conducted game play by manipulating one or more physical game components on a table surface, wherein the mimicked game play occurs at a remote location distinct from the casino pit of the gaming establishment;

tracking activities of the remotely positioned player to determine whether the activities at the remote location correctly mimic the conducted game play at the table; and providing information about the tracking to a customer service representative.

2. The method of claim 1 wherein the physical game components include at least one of: a card and a chip representing a wager.

3. The method of claim 1 which includes providing information to the remotely positioned player in a hotel room associated with the gaming establishment.

4. The method of claim 1 which includes providing information to the remotely positioned player in a location removed from a property associated with the gaming establishment.

5. The method of claim 1 which includes using a camera to capture images associated with the activities and sending captured images to the customer service representative.

6. The method of claim 1 which includes providing an audio signal from the game play at the table to the remotely positioned player.

7. The method of claim 1 which includes replicating environmental effects from the game play at the table for the remotely positioned player.

8. The method of claim 1 wherein replicating environmental effects includes reproducing at least one of sounds and smells.

9. The method of claim 1 which includes accepting a wager from the remotely positioned player by allowing the remotely positioned player to insert a chip into a chip receiver.

10. The method of claim 9 wherein accepting the wager includes including an indication of time the wager was placed.

11. The method of claim 9 which includes providing winnings to the remotely positioned player by a chip hopper.

12. The method of claim 1 wherein providing information about the game play to the remotely positioned player includes transmitting data on a continuous basis.

13. The method of claim 1 wherein providing information about the game play to the remotely positioned player includes transmitting data on a semi-continuous basis.

14. The method of claim 1 which includes verifying information about the remote player to insure the remote player is approved to use an associated account.

15. The method of claim 1 which includes receiving a request for assistance from a remotely positioned player.

16. The method of claim 15 which includes facilitating a response to the request by the customer service representative.

17. The method of claim 1 which includes receiving an error message associated with a peripheral device.

18. The method of claim 17 which includes facilitating a resolution to the error message by the customer service representative.

19. The method of claim 1 which includes identifying a disputed issue associated with the remotely positioned player.

20. The method of claim 19 which includes facilitating resolution of the disputed issue by the customer service representative.

21. The method of claim 20 which includes verifying resolution of the disputed issue.

22. The method of claim 1 which includes identifying an issue from received game data associated with the remote location.

23. The method of claim 22 which includes facilitating resolution of the issue by the customer service representative.

24. The method of claim 1 which includes identifying an issue associated with the remotely positioned player that may be addressed through remedial training of the remotely positioned player.

25. The method of claim 1 which includes soliciting feedback from the remotely positioned player relating to any interactions between the remotely positioned player and the customer service representative.

26. The method of claim 1 wherein the customer service representative is not involved in the game play at the table.

27. A method comprising:

monitoring game play conducted at a table located in a casino pit of a gaming establishment;

instructing a remotely positioned player to mimic the conducted game play at the table with a remote game play station, wherein the mimicked game play occurs at a remote location distinct from the casino pit of the gaming establishment and the remote game play station includes:

a playing surface copied from a playing surface at the table;

a wager receiver;

a benefit dispenser;

a card shoe adapted to dispense cards;

a camera to record remote game play at the remote game play station;

a microphone to receive audio signals from the remotely positioned player; and a speaker to provide audio signals to the remotely positioned player;

tracking remote game play activity at the remote game play station;

updating game play at the table based on the remote game play activity; and detecting discrepancies between the remote game play and the game play conducted at the table.

* * * * *